US007278794B2

(12) United States Patent
Kawaguchi et al.

(10) Patent No.: US 7,278,794 B2
(45) Date of Patent: Oct. 9, 2007

(54) WIRE DOT PRINTER HEAD AND WIRE DOT PRINTER

(75) Inventors: Takahiro Kawaguchi, Mishima (JP); Yasunobu Terao, Shizuoka (JP); Keishi Tsuchiya, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/940,338

(22) Filed: Sep. 14, 2004

(65) Prior Publication Data

US 2005/0201797 A1 Sep. 15, 2005

(30) Foreign Application Priority Data

Mar. 12, 2004 (JP) ..... 2004-070483

(51) Int. Cl.
*B41J 2/275* (2006.01)

(52) U.S. Cl. ..... 400/124.23; 400/124.11

(58) Field of Classification Search ..... 400/123.23
See application file for complete search history.

(56) References Cited

U.S. PATENT DOCUMENTS

| | | | | |
|---|---|---|---|---|
| 3,804,224 | A * | 4/1974 | Barnaby et al. | 400/124.14 |
| 4,537,520 | A | 8/1985 | Ochiai et al. | |
| 4,552,064 | A | 11/1985 | Sanders, Jr. et al. | |
| 4,674,896 | A | 6/1987 | Yasunaga et al. | |
| 4,697,939 | A | 10/1987 | Ara | |
| 4,755,645 | A | 7/1988 | Naoki et al. | |
| 4,767,227 | A | 8/1988 | Mitsuishi et al. | |
| 4,802,776 | A | 2/1989 | Miyazawa et al. | |
| 4,881,832 | A | 11/1989 | Mitsuishi et al. | |
| 4,962,876 | A | 10/1990 | Andou et al. | |
| 4,976,554 | A | 12/1990 | Shimosato et al. | |
| 4,988,223 | A | 1/1991 | Hilkenmeier et al. | |
| 4,993,854 | A | 2/1991 | Sato | |
| 5,063,116 | A | 11/1991 | Uchida | |
| 5,074,687 | A | 12/1991 | Gugel et al. | |
| 5,137,377 | A | 8/1992 | Ito et al. | |
| 5,205,659 | A | 4/1993 | Gugel et al. | |

(Continued)

FOREIGN PATENT DOCUMENTS

| | | | |
|---|---|---|---|
| JP | 60124262 | A | 7/1985 |

(Continued)

OTHER PUBLICATIONS

Machine translation of JP 2001253102 to Asada from Japanese Patent Office website.*

(Continued)

*Primary Examiner*—Daniel J. Colilla
(74) *Attorney, Agent, or Firm*—Frishauf, Holtz, Goodman & Chick, P.C.

(57) ABSTRACT

In order to realize a stabilized pivotal movement of an armature to thereby obtain pivotal force required for high-speed printing, a pivot shaft is held such that an armature having an attracted face that is in contact with a core, that has a coil wound therearound and has a pole face, and the pivot shaft is opposed to the core, whereby the armature becomes pivotable. An attracting direction of attraction force F acted on the attracted face by the core and the moving direction in which the attracted face moves due to the attraction force F are made substantially equal to each other.

33 Claims, 5 Drawing Sheets

U.S. PATENT DOCUMENTS

| | | | | |
|---|---|---|---|---|
| 5,290,112 | A | 3/1994 | Stempfle et al. | |
| 5,674,014 | A * | 10/1997 | Jordan | 400/124.02 |
| 5,975,776 | A | 11/1999 | Groenke | |
| 6,513,997 | B2 | 2/2003 | Terao | |
| 6,682,233 | B2 * | 1/2004 | Terao et al. | 296/214 |
| 6,698,956 | B1 * | 3/2004 | Terao et al. | 400/124.23 |
| 6,776,545 | B1 * | 8/2004 | Terao | 400/124.23 |
| 6,805,503 | B1 | 10/2004 | Tsuchiya et al. | |
| 6,848,843 | B1 | 2/2005 | Kawaguchi | |
| 6,872,016 | B2 | 3/2005 | Kawaguchi | |
| 6,994,482 | B2 | 2/2006 | Terao et al. | |
| 7,008,126 | B2 | 3/2006 | Kawaguchi | |
| 7,018,116 | B2 | 3/2006 | Tsuchiya et al. | |
| 7,020,023 | B2 | 3/2006 | Kuramori | |
| 7,048,455 | B2 | 5/2006 | Kawaguchi et al. | |
| 2003/0175063 | A1 | 9/2003 | Terao et al. | |
| 2004/0170461 | A1 | 9/2004 | Kawaguchi | |
| 2005/0058488 | A1 | 3/2005 | Kawaguchi | |
| 2005/0160576 | A1 | 7/2005 | Kawaguchi | |
| 2005/0201797 | A1 | 9/2005 | Kawaguchi et al. | |
| 2005/0201798 | A1 | 9/2005 | Kawaguchi et al. | |
| 2005/0201799 | A1 | 9/2005 | Tsuchiya et al. | |
| 2005/0201800 | A1 | 9/2005 | Tsuchiya et al. | |
| 2005/0201801 | A1 | 9/2005 | Kawaguchi et al. | |
| 2005/0207814 | A1 | 9/2005 | Kawaguchi | |
| 2005/0207815 | A1 | 9/2005 | Terao et al. | |
| 2005/0214052 | A1 | 9/2005 | Kawaguchi et al. | |
| 2006/0029449 | A1 | 2/2006 | Kawaguchi | |
| 2006/0104696 | A1 | 5/2006 | Kawaguchi | |

FOREIGN PATENT DOCUMENTS

| | | | |
|---|---|---|---|
| JP | 62101458 | A * | 5/1987 |
| JP | 02-011336 | A | 1/1990 |
| JP | 7-22994 | B2 | 2/1990 |
| JP | 3-007351 | A | 1/1991 |
| JP | 3-39256 | A | 2/1991 |
| JP | 03-191036 | A | 8/1991 |
| JP | 3-288660 | A | 12/1991 |
| JP | 4-002639 | A | 1/1992 |
| JP | 4-31061 | A | 2/1992 |
| JP | 04-105945 | A | 4/1992 |
| JP | 5-35288 | U | 5/1993 |
| JP | 6-218954 | A | 8/1994 |
| JP | 6-227000 | A | 8/1994 |
| JP | 07-125265 | A | 5/1995 |
| JP | 09-001890 | A | 1/1997 |
| JP | 09-187972 | A | 7/1997 |
| JP | 09-314868 | A | 12/1997 |
| JP | 10-006537 | | 1/1998 |
| JP | 2833001 | B2 | 10/1998 |
| JP | 10-291330 | A | 11/1998 |
| JP | 2850673 | B2 | 11/1998 |
| JP | 11-78075 | A | 3/1999 |
| JP | 2944562 | A | 6/1999 |
| JP | 11-291524 | A | 10/1999 |
| JP | 2000-280497 | A | 10/2000 |
| JP | 2001-219586 | A | 8/2001 |
| JP | 2001253102 | A * | 9/2001 |

OTHER PUBLICATIONS

U.S. Appl. No. 10/655,281, Inventor: Kawaguchi, T., Filing date: Sep. 3, 2003.
U.S. Appl. No. 10/655,894, Inventor: Kawaguchi, T., Filing date: Sep. 4, 2004.
U.S. Appl. No. 10/764,642, Inventor: Kawaguchi, T., Filing date: Jun. 26, 2004.
U.S. Appl. No. 10/940,362, Inventor: Kawaguchi, T. et al,. Filing date: Sep. 14, 2004.
U.S. Appl. No. 10/940,361, Inventor: Kawaguchi, K. et al,. Filing date: Sep. 14, 2004.
U.S. Appl. No. 10/940,432, Inventor: Kawaguchi, T. Filing date: Sep. 14, 2004.
U.S. Appl. No. 10/940,492, Inventor: Tsuchiya, K. et al,. Filing date: Sep. 14, 2004.
U.S. Appl. No. 11/073,118, Inventor: Kawaguchi et al., Filing date: Mar. 3, 2005.
U.S. Appl. No. 11/073,117, Inventor: Tsuchiya et al., Filing date: Mar. 3, 2005.
U.S. Appl. No. 11/073,092, Inventor: Kawaguchi et al., Filing date: Mar. 3, 2005.
U.S. Appl. No. 11/073,093, Inventor: Kawaguchi et al., Filing date: Mar. 3, 2005.

* cited by examiner

WIRE DOT PRINTER HEAD AND WIRE DOT PRINTER

CROSS REFERENCE TO RELATED APPLICATION

The present application is based on Japanese Priority Document 2004-70483 filed on Mar. 12, 2004, the content of which is incorporated herein by reference.

BACKGROUND OF THE INVENTION

1. Field of the Invention

The present invention relates to a wire dot printer head and a wire dot printer.

2. Discussion of the Background

There has been known a wire dot printer head wherein an armature with a printing wire connected thereto is pivoted between a printing position and a stand-by position, and when the armature is pivoted to the printing position, a tip of the wire is brought into collision with a printing medium such as a paper to effect printing. In a certain wire dot printer head of this type, there has been proposed a device wherein a magnetic flux is produced by a coil around the armature to be pivoted for forming a magnetic circuit that causes the armature to be attracted from a stand-by position to a printing position to effect printing (see Japanese Published Unexamined Patent Application No. 2001-219586).

As shown in FIG. 5, in the wire dot printer head disclosed in the patent document 1, an armature 101 holding a printing wire is provided at the position that is a printing position and opposite to a core 103 having a contact face 102 that comes in contact with the armature 101. This armature 101 has a contact face 104 that comes in contact with the core 103 at its printing position and a pivot shaft 105. The armature 101 is provided pivotably with the pivot shaft 105 as a center. This pivot shaft 105 is mounted on a yoke that is for forming a magnetic circuit, and is supported by the yoke 106 and a side yoke (not shown) (in more detail, see FIG. 1 in Japanese Published Unexamined Patent Application No. 2001-219586).

Further, provided on the side yoke is an elastic spacer for fixing the position of the pivot shaft 105 of the armature 101 with elastic force (in more detail, see FIGS. 3 and 4 in Japanese Published Unexamined Patent Application No. 2001-219586). This prevents the shake of the pivot shaft 105 during the printing operation, thereby enhancing durability of the yoke 106 and the side yoke.

However, the armature 101 pivots as much as 2500 times per second between the printing position and the stand-by position with a recent increased printing speed, so that vigorous vibration occurs during the printing operation. In the wire dot printer head disclosed in the patent document 1, it is difficult to restrain the movement of the pivot shaft 105 of the armature 101 due to the vigorous vibration, particularly it is difficult to prevent the movement of the pivot shaft 105 of the armature 101 in the radius direction of the yoke 106 (in the rightward direction in FIG. 5). Therefore, the pivot shaft 105 slightly moves, thereby wearing out the surface of the yoke 106 and the side yoke. Further, the pivotal movement of the armature 101 is not stabilized Moreover, even in case where the pivot shaft 105 is held by another supporting member other than the yoke 106, the pivot shaft 105 moves in the radius direction of the yoke 106, thereby wearing out the surface of the supporting member.

On the other hand, supposing that, at an intersection point K between a virtual circle A wherein the shortest distance from the center of the pivot shaft 105 to the center of the contact face 104 is defined as a radius with the center of the pivot shaft 105 of the armature 101 as a center and the contact face 104, attraction force acted on the contact face 104 by the core 103 is defined as F and the angle made by this attraction force F and the tangential direction is defined as θ as shown in FIG. 5, force of the attraction force F in the tangential direction, i.e., component of force in the rotating direction becomes Fcosθ. This component of force in the rotating direction Fcosθ becomes pivotal force of the armature 101. In this case, the armature 101 in the patent document 1 has the angle θ of about 45 degrees, as shown in FIG. 5, that is great, so that the attraction force F and the component of force in the rotating direction (pivotal force) Fcosθ are greatly different from each other. Specifically, the attraction force F is not effectively converted into the pivotal force of the armature 101. This cannot provide pivotal force required for high-speed printing.

Further, in the armature 101 in the patent document 1, force acted in the radius direction of the yoke 106 (in the rightward direction in FIG. 5) is great in the component of force in the rotating direction Fcosθ, so that the pivot shaft 105 moves in that direction. This provides the non-stabilized pivotal movement of the armature 101. In particular, the surface of the yoke 106 and the side yoke made of a magnetic material is worn out due to the movement of the pivot shaft 105 of the armature 101. It is possible to prevent the wearout of the yoke 106 and the side yoke by providing a hardening process such as a nitriding on the surface of the yoke 106 or the surface of the side yoke. In this case, magnetic characteristic of the magnetic circuit is reduced. Therefore, pivotal force required for high-speed printing cannot be obtained.

SUMMARY OF THE INVENTION

The present invention is accomplished in view of the above-mentioned circumstance, and aims to realize a stabilized pivotal movement and to obtain pivotal force required for high-speed printing.

In a wire dot printer head according to the present invention, an armature that has an attracted face coming in contact with a pole face and a pivot shaft to support a printing wire is opposed to a core having a coil therearound and the pole face, and the armature is pivotably supported by the pivotal shaft, wherein an attracting direction of attraction force acted on the attracted face by the core and a moving direction in which the attracted face moves due to the attraction force are made substantially equal to each other, thereby being effectively converting the attraction force caused by the core into pivotal force of the armature.

A wire dot printer according to the present invention comprises the above-mentioned wire dot printer head, a platen opposite to the wire dot printer head, a carriage that holds the wire dot printer head and reciprocates along the platen and a printing medium transporting section that transports a printing medium between the wire dot printer head and the platen, wherein the wire dot printer head, the carriage and the printing medium transporting section are drive-controlled, to thereby effect printing based upon printing data.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Preferred embodiments for carrying out the present invention will be explained with reference to FIGS. 1 to 4.

[Wire Dot Printer Head]

Figure 1:
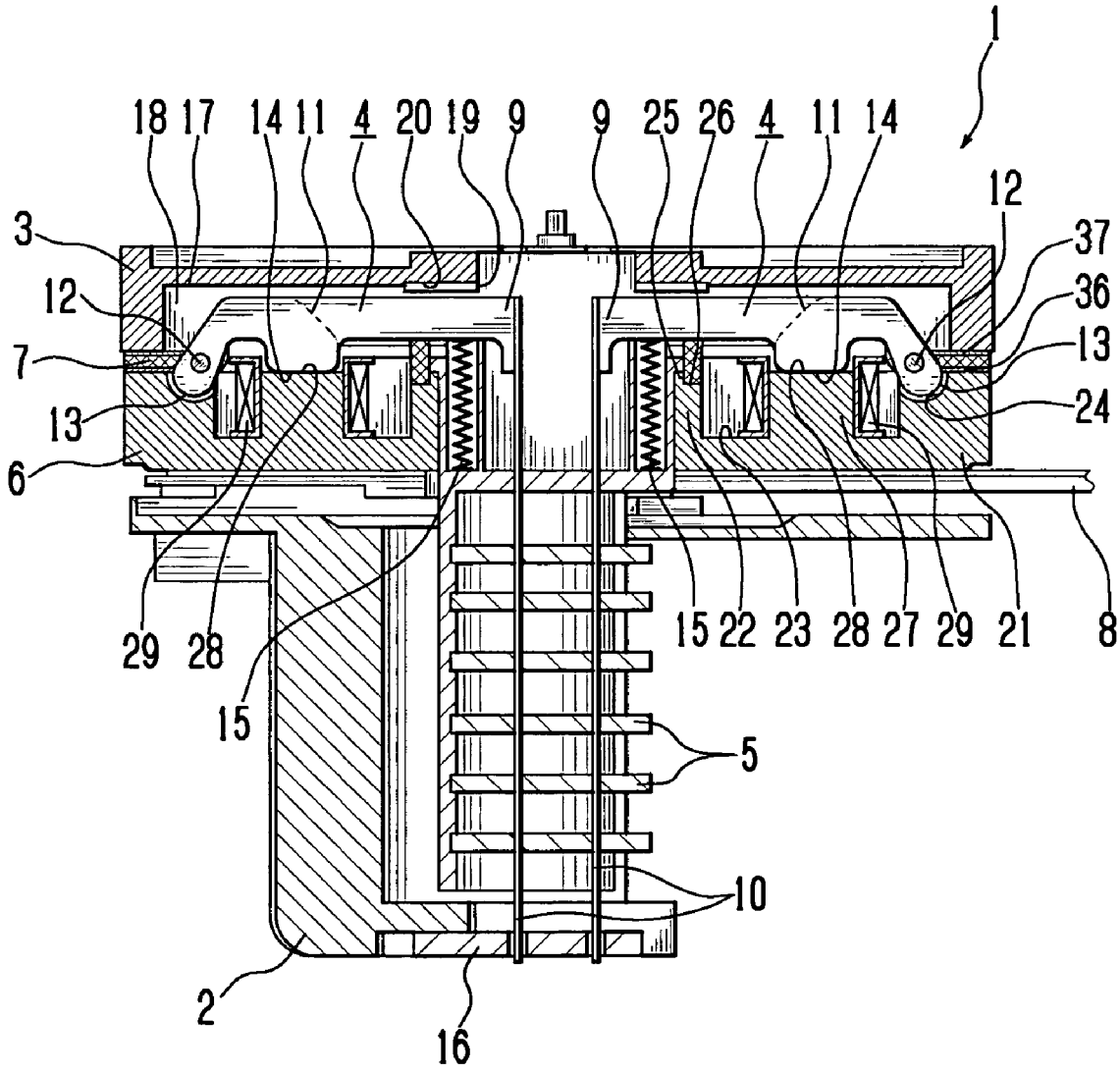
FIG. 1 is a front view in central vertical section of a wire dot printer head according to one embodiment of the present invention.
Figure 2:
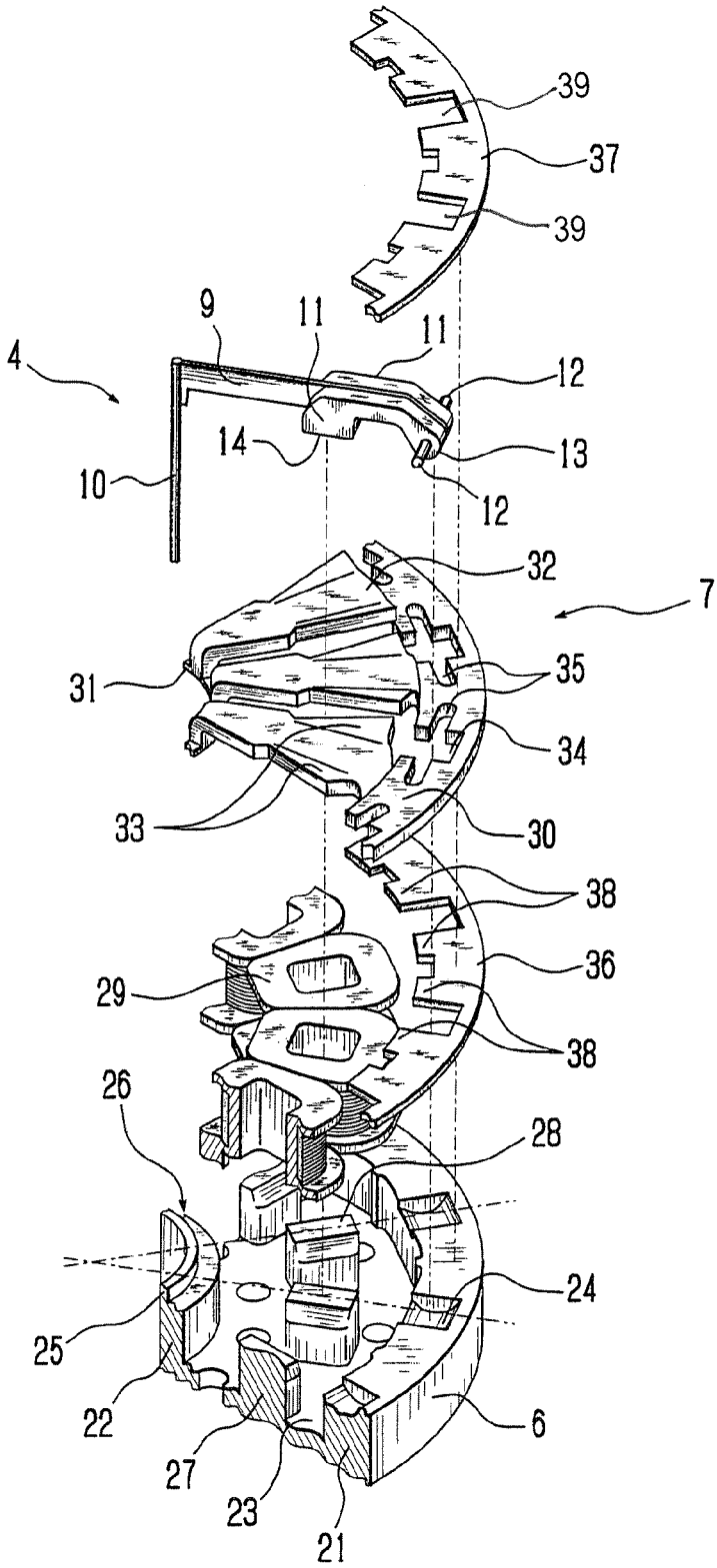
FIG. 2 is an exploded perspective view schematically showing a part of the wire dot printer head according to one embodiment of the present invention.

Firstly, the entire construction of a wire dot printer head 1 will be explained with reference to FIGS. 1 and 2. FIG. 1 is a front view in central vertical section of a wire dot printer head 1 according to the embodiment and FIG. 2 is an exploded perspective view schematically showing a part of the wire dot printer head 1.

The wire dot printer head 1 has a front case 2 and a rear case 3 coupled together with a mounding screw (not shown). Disposed between the front case 2 and the rear case 3 are armatures 4, wire guides 5, yoke 6, armature spacer 7 and circuit board 8.

Each of the armatures 4 has an arm 9 that is formed into a plate-like shape and supports a printing wire (hereinafter simply referred to as a wire) 10 at one end thereof in the lengthwise direction (in the direction in which the arm 9 extends), magnetic circuit forming members 11 formed at both side faces of the arm 9 in the widthwise direction for forming a magnetic circuit and a pivot shaft 12 that is rendered to be a center of the pivot. The wire 10 is soldered to one end of the arm 9. An arc-shaped section 13 is formed at the other end of the armature 4. An attracted face 14 is formed at each of the magnetic circuit forming members 11. This attracted face 14 is positioned at the central section of the armature 4 in the lengthwise direction.

Plural armatures 4 described above are radially arranged with respect to the center of the yoke 6. Each of the armatures 4 is held at the surface of the yoke 6 such that it is pivotable in the direction away from the yoke 6 with the pivot shaft 12 as a center, and it is urged by an urging member 15 such as a coil spring toward the direction away from the yoke 6. The urging member 15 is provided for executing the urging operation.

Each of the wire guides 5 slidably guides the wire 10 for causing the tip of the wire 10 to strike against the predetermined position of a printing medium. Further, provided at the front case 2 is a tip guide 16 that aligns the tip of the wire 10 in a predetermined pattern and slidably guides the wire 10. It should be noted that the wire 10 moves to a position where the tip thereof strikes against the predetermined position, e.g., the printing medium such as a sheet or the like, with the pivotal movement of the armature 4, when the armature 4 pivots to the printing position.

A cylindrical section 18 having a bottom face section 17 at the side of one end is provided at the rear case 3. A mounting recess 20 to which a metallic annular armature stopper 19 is attached is formed at the central portion of the bottom face section 17. The mounting of the armature stopper 19 is performed by fitting the armature stopper 19 into the mounting recess 20. When the armature 4 pivots from the printing position by the urging member 15, the arm 9 as part of the armature 4 comes into contact with the armature stopper 19, thereby stopping the pivotal movement of the armature 4. Therefore, the armature stopper 19 has a function for defining the stand-by position of the armature 4.

The circuit board 8 has a driving circuit for controlling the pivotal movement of the armature 4 between the printing position and the stand-by position. The driving circuit of the circuit board 8 selectively pivots an optional armature 4 among plural armatures 4 during the printing operation.

The yoke 6 has a pair of cylindrical sections 21 and 22 that are concentrically mounted, each having a different diameter. The size in the shaft direction (in the vertical direction in FIG. 1, i.e., in the shaft direction of the yoke 6) of each cylindrical section 21 and 22 is set equal to each other. The cylindrical section 21 at the outer periphery side and the cylindrical section 22 at the inner periphery side are formed integral by a bottom face 23 formed so as to close one end in the shaft direction. It should be noted that the yoke 6 is formed by, for example, a Lost Wax method or MIM (Metal Injection Molding) method with the use of permendule (PMD), that is a magnetic material excellent in magnetic characteristic, as a material. The yoke 6 described above is held between the front case 2 and the rear case 3 in a state in which its open side opposite to the bottom face 23 is opposed to an open, opposite end side of the rear case 3.

Formed at the outer periphery-side cylindrical section 21 are plural recesses 24 that are equal in number of the armatures 4. Each of the recesses 24 has the inner peripheral face formed into a concave shape having a curvature radius approximately same as that of the outer peripheral face of the arc-shaped section 13 of the armature 4. The arc-shaped section 13 formed at one end of the armature 4 is slidably fitted into the recess 24.

A fitted section 25 having an annular shape is provided at the inner periphery-side cylindrical section 22. The fitted section 25 is integrally provided with the inner periphery-side cylindrical section 22 so as to be positioned concentric with the inner periphery-side cylindrical section 22. The outer diameter of the fitted section 25 is set smaller than the outer diameter of the inner periphery-side cylindrical section 22. Accordingly, a step section 26 is formed at the inner periphery-side cylindrical section 22 by the fitted section 25.

Provided integral with the bottom face 23 are plural cores 27 annularly arranged between the outer periphery-side cylindrical section 21 and the inner periphery-side cylindrical section 22. The size of each core 27 in the shaft direction of the yoke 6 is set equal to the size of each cylindrical section 21 and 22 in the shaft direction of the yoke 6.

A pole face 28 is formed at one end of each core 27 in the shaft direction of the yoke 6. The pole face 28 of the core 27 is formed so as to oppose the attracted face 14 of the magnetic circuit forming members 11 provided at the armature 4. Moreover, a coil 29 is wound around the outer periphery of each core 27. Specifically, the yoke 6 has plural cores 27 annularly arranged, each core having the coil 29 wound therearound. Although the winding directions of all coils are set equal to one another in this embodiment, the invention is not limited thereto. For example, coils having different winding directions may be selectively arranged.

The armature spacer 7 has a pair of ring-shaped members 30 and 31 having diameters approximately equal to the diameters of the cylindrical sections 21 and 22 of the yoke 6 and plural guide members 32 radially bridged between the ring-shaped members 30 and 31 so as to be positioned between the armatures 4. These guide members 32 form a side magnetic path with respect to the armature 4. The outer periphery-side ring-shaped member 30 and the inner periphery-side ring-shaped member 31 are concentrically provided. The outer periphery-side ring-shaped member 30, inner periphery-side ring-shaped member 31 and the guide member 32 are integrally formed The armature spacer 7 having the above-mentioned construction is made of, for example, permendule (PMD) that is a magnetic material excellent in magnetic characteristic.

When the armature spacer 7 is disposed on the yoke 6, the outer periphery-side ring-shaped member 30 and the inner periphery-side ring-shaped member 31 come in contact with the cylindrical sections 21 and 22 of the yoke 6, whereby the inner periphery-side ring-shaped member 31 is fitted to the fitted section 25. It should be noted that the inner diameter of the inner periphery-side ring-shaped member 31 is set equal to or slightly greater than the outer diameter of the fitted section 25.

Each guide member 32 has a side yoke section 33 extending substantially radially of the ring-shaped members 30 and 31 toward the direction away from the pole face 28 of the core 27 and in the oblique direction. This side yoke section 33 has a blade-like shape that is wider toward the outer periphery-side ring-shaped member 30 from the inner periphery-side ring-shaped member 31.

Since the armature spacer 7 has plural guide members 32 bridged between a pair of ring-shaped members 30 and 31, slit-like guide grooves 34 are ensured that are open along the radius direction of the ring-shaped members 30 and 31. Each guide groove 34 is formed to have a width such that the side yoke section 33 comes close to the associated magnetic circuit forming member 11 to such an extent that it does not obstruct the pivotal movement of the armature 4.

Further, the guide groove 34 communicates with the outer periphery-side ring-shaped member 30. Formed at the guide groove 34 at the outer periphery-side ring-shaped member 31 is a bearing groove 35 that is a cut-out section open contiguously to the guide groove 34 at the position of both side faces of the guide groove 34 along the outer diameter direction of the ring-shaped member 30. The pivot shaft 12 of the armature 4 is fitted into this bearing groove 35. Specifically, the pivot shaft 12 of the armature 4 is held by the yoke 6 and the armature spacer 7 such that the armature 4 opposes to the core 27.

Provided between the yoke 6 and the armature spacer 7 is a pin support plate 36 that prevents the contact between the pivot shaft 12 of each of the plural armatures 4 and the yoke 6. A pressing member 37 for pressing the pivot shaft 12 of each of the plural armatures 4 is mounted on the armature spacer 7.

The pin support plate 36 is annularly formed so as not to obstruct the pivoting of the plural armatures 4 and has plural contact preventing sections 38. The plural contact preventing sections 38 are mounted between the yoke 6 and the plural armatures 4 respectively. Further, the pin support plate 36 is formed into a plate-like shape having a thickness of about 0.20 mm and mounted on the yoke 6 in order to form a magnetic path between the core 27 of the yoke 6 and the armatures 4 with the shortest distance. A hardening process is provided on the surface of the pin support plate 36. A nitriding is used, for example, as the hardening process.

The pressing member 37 is a plate-like member for pressing the pivot shaft 12 of each of the plural armatures 4 by coupling the front case 2 and the rear case 3 with a mounting screw. This pressing member 37 is annularly formed so as not to hinder the pivotal movement of the armature 4. The pressing member 37 has plural groove sections 39 having a width approximately the same as the width of the armature 4 and respectively extending toward its radius direction. A surface hardening process is provided on the surface of the pressing member 37. A nitriding is used as the surface hardening process, for example.

The diameter of the pivot shaft 12 of the armature 4 is about 0.90 mm and the thickness of the armature spacer 7 composing the bearing groove 35 is about 0.80 mm. Therefore, when the pivot shaft 12 of the armature 4 is fitted into the bearing groove 35, the pivot shaft 12 protrudes from the bearing groove 35 by about 0.10 mm to be in contact with the pressing member 37, thereby providing a secure support.

Figure 3:
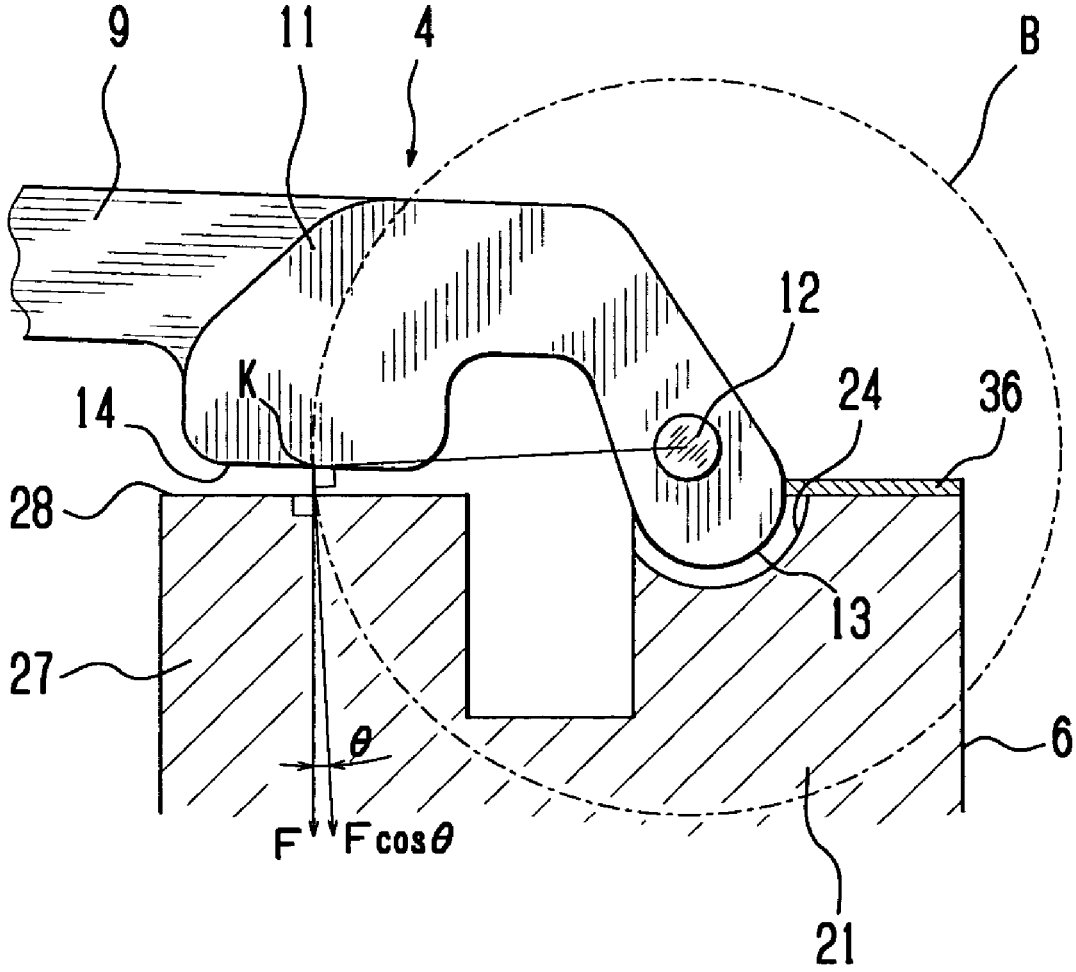
FIG. 3 is an exploded perspective view schematically showing a part of a surrounding section of an armature provided at the wire dot printer head according to one embodiment of the present invention.

The structure of the armature 4 will be explained here with reference to FIG. 3. FIG. 3 is an exploded perspective view schematically showing a part of a surrounding section of the armature.

The armature 4 is formed such that the attracted face 14 of the magnetic circuit forming member 11 and the pivot shaft 12 are positioned on the substantially same plane. Specifically, the armature 4 has the attracted face 14 that is a contact face contacting to the pole face 28 of the core 27 and the pivot shaft 12 positioned on the substantially same plane as the attracted face 14.

More specifically, supposing that, at an intersection point K between a virtual circle B wherein the shortest distance from the center of the pivot shaft 12 to the center of the attracted face 14 is defined as a radius with the center of the pivot shaft 12 of the armature 4 as a center and the attracted face 14, attraction force acted on the attracted face 14 by the core 27 is defined as F and the angle made by the attracting direction of this attraction force F and the moving direction in which the attracted face 14 moves, i.e., the tangential direction at the intersection point K, is defined as $\theta$, force of the attraction force F in the tangential direction, i.e., component of force in the rotating direction becomes $F\cos\theta$. This component of force in the rotating direction $F\cos\theta$ becomes pivotal force of the armature 4. It should be noted that the attraction force F is, for example, force acted in the direction perpendicular to the pole face 28 of the core 27. In this case, the attracted face 14 and the pivot shaft 12 of the armature 4 are positioned to establish a relationship of $\cos\theta \approx 1$. Accordingly, the angle $\theta$ is so small that it can be neglected. Specifically, it is nearly zero and $F\cos\theta$ is nearly F.

In other words, supposing that the angle made by the tangential direction and the attracting direction of the attraction force F is $\theta$ at the intersection point K, the attracted face 14 and the pivotal shaft 12 are positioned so as to establish the relationship of $\theta \approx 0$. By this, the attracting direction of the attraction force F and the moving direction in which the attracted face 14 moves by the attraction force F (the tangential direction extending toward the core 27 at the intersection point K) are substantially equal to each other within the pivotal range. Therefore, the attraction force F and the component of force in the rotating direction $F\cos\theta$ are substantially equal to each other ($F \approx F\cos\theta$), that makes it possible to effectively convert the attraction force F into the pivotal force (impact force) of the armature 4. It is most preferable that the angle θ is 0 degree here. As the angle θ is close to 0, the attraction force F can effectively be converted into the pivotal force of the armature 4.

[Wire Dot Printer]

Figure 4:
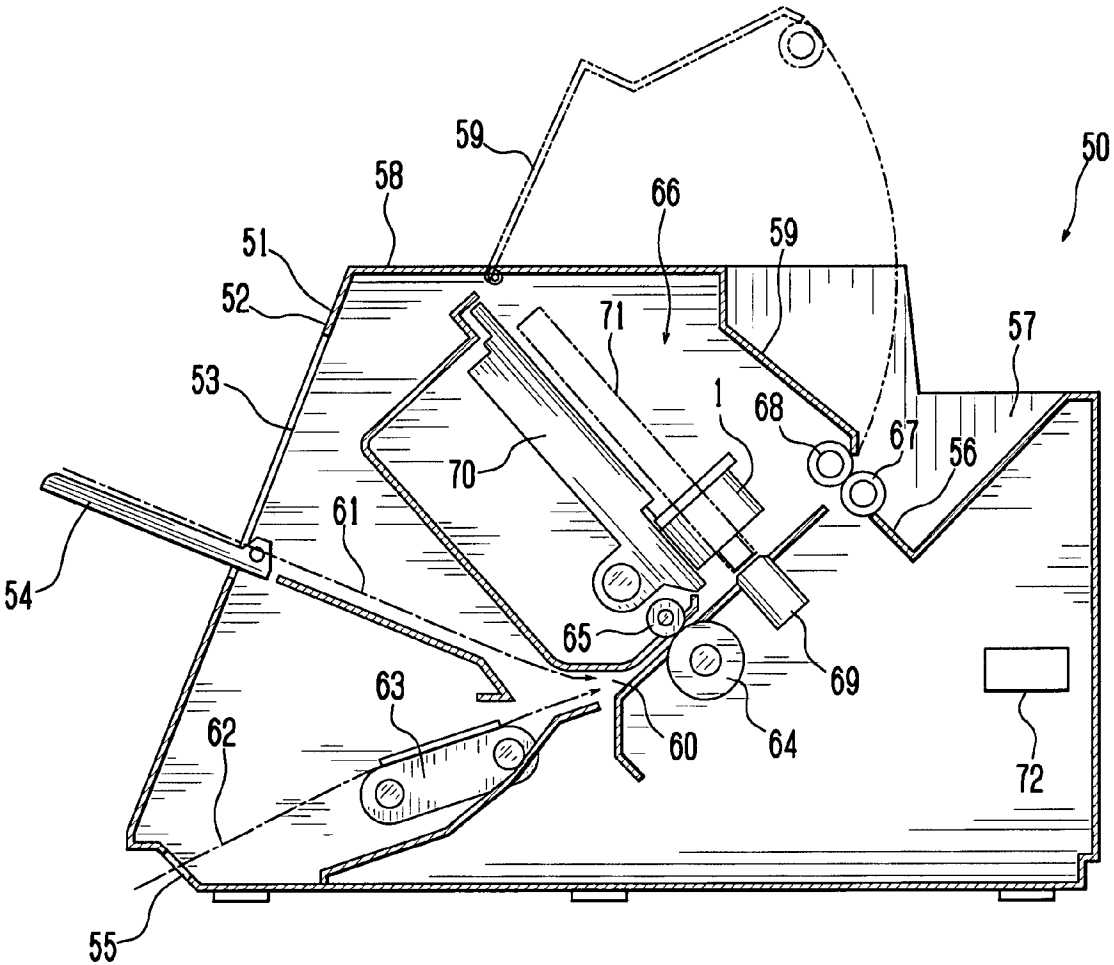
FIG. 4 is a longitudinal side view schematically showing a wire dot printer according to one embodiment of the present invention.
Figure 5:
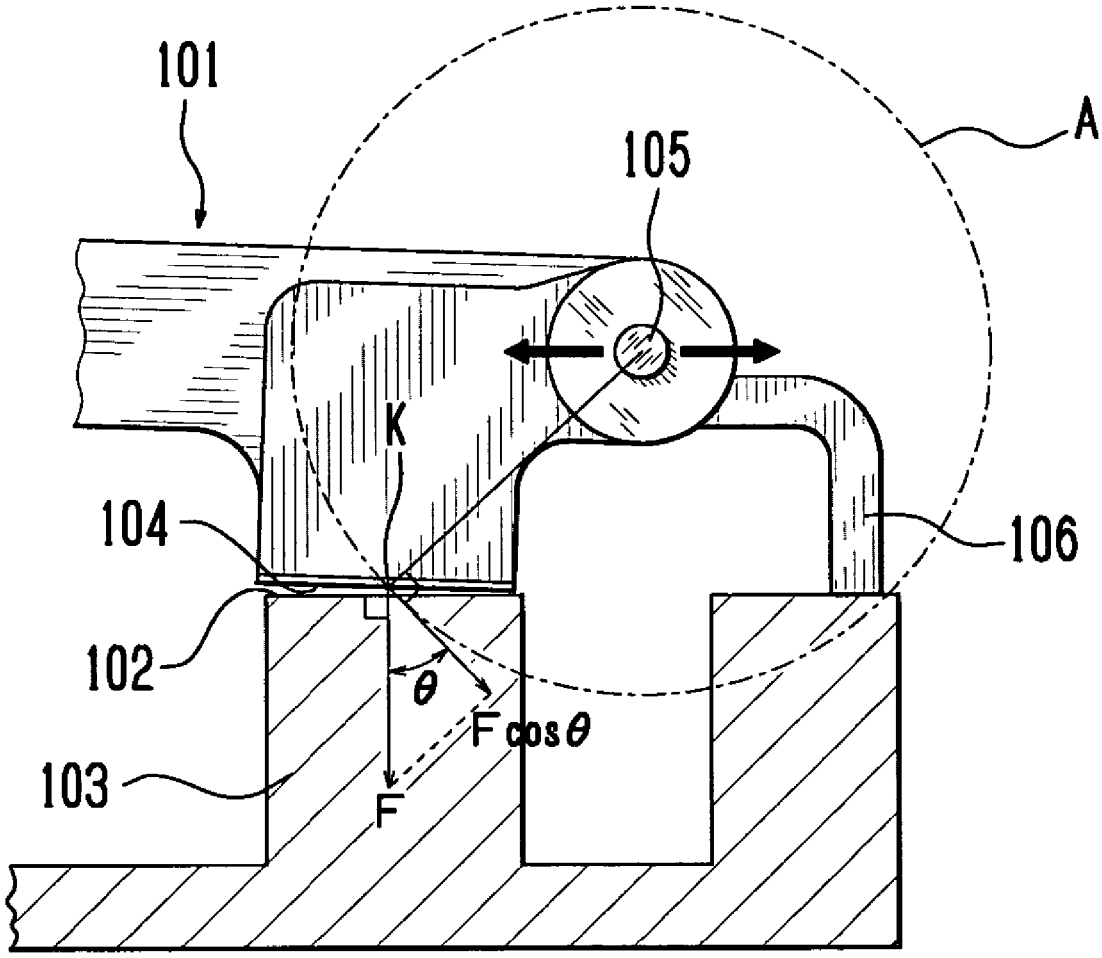
FIG. 5 an exploded perspective view schematically showing a part of a surrounding section of an armature provided at a conventional wire dot printer head.

Subsequently explained with reference to FIG. 4 is a wire dot printer 50 provided with the wire dot printer head 1 described above. FIG. 4 is a longitudinal side view schematically showing the wire dot printer 50 according to the embodiment of the present invention.

The wire dot printer 50 has a housing case 51. An opening section 53 is formed at the front face 52 of the housing case 51. A manual tray 54 is mounted at the opening section 53 so as to be able to be opened and closed. Further, a paper feed port 55 is provided at the lower section of the front face 52 of the housing case 51, while a discharge tray 57 is provided at the back face side 56. Moreover, an open/close cover 59 is pivotably provided at the top face 58 of the housing case 51. The opened open/close cover 59 is shown by a virtual line in FIG. 4.

A sheet transporting path 60 that is a printing medium transporting path is provided in the housing case 51. The upstream side in the sheet transporting direction of the sheet transporting path 60 communicates with a paper feed path 61 arranged on the extended face of the opened manual tray 54 and a paper feed path 62 communicating with the paper feed port 55. The downstream side in the sheet transporting direction of the sheet transporting path 60 communicates with the discharge tray 57. A tractor 63 for transporting a sheet is provided in the sheet transporting path 62.

In the sheet transporting path 60, a transporting roller 64 and a pressing roller 65 are arranged so as to be opposite to each other, wherein the pressing roller 65 comes in pressed contact with the transporting roller 64. These transporting roller 64 and the pressing roller 65 transport a sheet that is a printing medium and compose a sheet transporting section that is a printing medium transporting section. Further, disposed in the sheet transporting path 60 is a printer section 66 that performs a printing operation for the transported sheet. A discharge roller 67 is disposed at the inlet of the discharge tray 57. A pressing roller 68 that comes in pressed contact with the discharge roller 67 is pivotably supported at the side of a free end of the open/close cover 59.

The printer section 66 is composed of a platen 69 arranged in the sheet transporting path 60, a carriage 70 that can reciprocate along this platen 69 in the direction perpendicular to the sheet transporting path 60, the above-mentioned wire dot printer head 1 mounted on the carriage 70 and an ink ribbon cassette 71. It should be noted that the ink ribbon cassette 71 is removably mounted.

The carriage 70 is driven by a motor (not shown) to be reciprocated along the platen 69. The wire dot printer head 1 reciprocates in the main scanning direction with the reciprocating movement of the carriage 70 along the platen 69. Therefore, a head driving mechanism can be realized by the carriage 70 or motor in this embodiment. Further, the wire dot printer 50 has incorporated therein a driving control section 72 for controlling each section in the housing case 51. This driving control section 72 drive-controls each section of the printer section 66, tractor 63 and motor.

In this construction, when a single sheet is used as a sheet, it is fed from the manual tray 54. On the other hand, when plural sheets are continuously used, they are fed from the sheet feed port 55. Either sheet (not shown) is transported by the transporting roller 64, printed by the wire dot printer head 1 and discharged onto the discharge tray 57 by the discharge roller 67.

The printing is performed as follows. Specifically, the coil 29 is selectively excited in the wire dot printer head 1, whereby the armature 4 is attracted by the pole face 28 of the core 27 to be pivoted about the pivot shaft 12, resulting in that the wire 10 is pressed toward the sheet on the platen 69 via the ink ribbon (not shown). When the coil 29 is de-energized, the armature 4 returns under the urging force of the urging member 15 and stops at the stand-by position by the armature stopper 19. Although a sheet is used here as the printing medium, the invention is not limited thereto. For example, a pressure-sensitive color-developing paper can be used in which the color development occurs at the pressurized section. In case where the pressure-sensitive color-developing paper is used as the printing medium, the color development occurs at the section pressurized by the pressure of the wire 10 provided at the wire dot printer head 1, to thereby execute the printing.

Upon performing the printing operation by the wire dot printer 50, a coil 29 is selectively energized based upon the printing data by the control of the driving control section 72. Then, a magnetic circuit is formed among the core 27 on which the selected coil 29 is mounted, the magnetic circuit forming members 11 of the armature 4 opposed to the core 27, a pair of side yoke sections 33 opposed to the magnetic circuit forming members 11, guide members 32, the outer- and inner-periphery side cylindrical portions 21, 22 of the yoke 6, the bottom face 23 and again the core 27.

The formation of this magnetic circuit generates attraction force that attracts the magnetic circuit forming members 11 to the pole face 28 of the core 27 between the attracted face 14 of the magnetic circuit forming member 11 and the pole face 28 of the core 27. This attraction force allows the armature 4 to pivot about the pivot shaft 12 in the direction in which the attracted face 14 of the magnetic circuit forming member 11 is attracted to the pole face 28 of the core 27. In this case, the component of force in the rotating direction $F\cos\theta$ has $\cos\theta$ that is nearly 1 ($\cos\theta \approx 1$), whereby it is substantially equal to the attraction force F. Specifically, the attraction force F is effectively converted into the pivotal force of the armature 4. It should be noted that the position where the attracted face 14 of the magnetic circuit forming member 11 of the armature 4 comes in contact with the pole face 28 of the core 27 is defined as the printing position in this embodiment.

As a result of the pivotal movement of the armature 4 to the printing position, the tip of the wire 10 projects to the side of the sheet. Since the ink ribbon is interposed between the wire dot printer head 1 and the sheet at this time, the pressure from the wire 10 is transmitted to the sheet via the ink ribbon and the ink from the ink ribbon is transferred onto the sheet, thereby carrying out the printing.

When the coil 29 is de-energized, the magnetism so far developed becomes extinct, so that the magnetic circuit also vanishes. Consequently, the attractive force for attracting the magnetic circuit forming member 11 to the pole face 28 of the core 27 disappears, so that the armature 4 is urged away from the yoke 6 with an urging force of the urging member 15 and pivots about the pivot shaft 12 toward the stand-by position. The armature 4 pivots toward the stand-by position until its arm 9 comes into contact with the armature stopper 19, whereupon the armature is stopped at the stand-by position.

The printing operation as described above is performed at high speed (for example, the printing speed of 2500 times per second) In this case, the armature 4 is formed such that its attracted face 14 and the pivot shaft 12 are positioned on the substantially same plane (see FIG. 3), whereby the attracting direction of the attraction force F and the moving direction in which the attracted face 14 moves due to the attraction force F (in the tangential direction extending toward the core 27 at the intersection point K in FIG. 3) are substantially equal to each other within the pivotal range as shown in FIG. 3. Accordingly, the attraction force F and the component of force in the rotating direction Fcosθ are substantially equal to each other (F≈Fcosθ), that makes it possible to effectively convert the attraction force F, i.e., substantially the whole attraction force F, into the pivotal force of the armature 4. Therefore, the pivotal force required for high-speed printing can be obtained, thereby being capable of realizing high-speed printing.

Further, the component of force in the radius direction of the yoke 6 (in the rightward direction in FIG. 3) in the component of force in the rotating direction Fcosθ is small, i.e., it is nearly 0, so that there is no chance the pivot shaft 12 moves in that direction. This can realize the stabilized pivotal movement of the armature 4, and further can prevent the wearout of the bearing groove 35 of the armature spacer 7 due to the pivot shaft 12.

Moreover, as described above, the pivot shaft 12 of the armature 4 does not move in the radius direction of the yoke 6, whereby there is no chance that the pivot shaft 12 does not scrape the pressing member 37 and the pin support plate 36 when it moves. Therefore, the pin support plate 36 and the pressing member 37 are free from wearout due to the pivot shaft 12, thereby being capable of achieving a long service life of the wire dot printer head 1.

In this embodiment, supposing that, at the intersection point K between the virtual circle B wherein the shortest distance from the center of the pivot shaft 12 to the center of the attracted face 14 is defined as a radius with the center of the pivot shaft 12 of the armature 4 as a center and the attracted face 14, the angle made by the attracting direction of this attraction force F acted on the attracted face 14 and the tangential direction is defined as θ, the attracted face 14 and the pivot shaft 12 are positioned so as to establish the relationship of θ−≈0 (see FIG. 3). This can effectively convert the attraction force F into the pivotal force of the armature 4.

Further, the attracted face 14 of the armature 4 and the pivot shaft 12 are positioned on the substantially same plane in this embodiment, thereby being capable of effectively converting the attraction force F into the pivotal force of the armature 4 with a simple construction.

Additionally, the wire dot printer 50 in this embodiment is provided with the above-mentioned wire dot printer head 1, platen 69 opposite to the wire dot printer head 1, carriage 70 that holds the wire dot printer head 1 and reciprocates along the platen 69 and transporting roller 64 and the pressing roller 65 serving as the printing medium transporting section for transporting a printing medium between the wire dot printer head 1 and the platen 69, wherein the wire dot printer head 1, carriage 70, transporting roller 64 and the pressing roller 65 are drive-controlled to effect printing based upon printing data. Therefore, a stabilized pivotal movement of the armature 4 can be realized, thereby being capable of obtaining pivotal force required for high-speed printing. As a result, high-speed printing can be realized.

Obviously, numerous modifications and variations of the present invention are possible in light of the above teachings. It is therefore to be understood that within the scope of the appended claims, the invention may be practiced otherwise than as specifically described herein.

What is claimed is:

1. A wire dot printer head, comprising:

a printing wire;

a core to which a coil is wound and which has a pole face;

a yoke which supports the core, the core being formed integrally with the yoke;

an armature which holds the printing wire, and which has an attracted face that is attracted by the core to contact the pole face and a pivot shaft serving as a center of pivoting of the armature; and a support plate member that abuts the pivot shaft, and which is positioned between the yoke and the pivot shaft to prevent contact between the yoke and the pivot shaft;

wherein an attracting direction of attraction force acted on the attracted face by the core and a moving direction in which the attracted face moves due to the attraction force are substantially equal to each other; and wherein a surface of the support plate member is hardened by a hardening process, and the support plate member has a thickness such that a magnetic path between the core and the armature is formed with a shortest distance.

2. The wire dot printer head according to claim 1, wherein a virtual circle is defined such that a center of the pivot shaft is a center of the circle and a shortest distance from the center of the pivot shaft to a center of the attracted face is a radius of the circle, and an angle θ is defined as an angle between a tangential direction, which is tangential to the virtual circle at an intersection of the virtual circle with the attracted face, and the attracting direction of the attraction force, and wherein the attracted face and the pivot shaft are positioned so as to establish a relationship of θ≈0.

3. The wire dot printer head according to claim 1 or 2, wherein the attracted face and the pivot shaft are positioned on substantially a same plane.

4. The wire dot printer head according to claim 1, wherein the yoke includes an outer periphery section having a plurality of recesses.

5. The wire dot printer head according to claim 4, wherein the armature includes an arc-shaped portion that slidably fits into one of the plurality of recesses.

6. The wire dot printer head according to claim 5, wherein said one of the plurality of recesses includes an inner peripheral face having a concave shape with a curvature radius approximately equal to a curvature radius of an outer peripheral face of the arc-shaped portion of the armature.

7. The wire dot printer head according to claim 5, wherein the support plate member has grooves aligned with the recesses of the yoke to permit access to the recesses of the yoke by the arc-shaped portion of the armature.

8. The wire dot printer head according to claim 4, wherein the support plate member is substantially flat.

9. The wire dot printer head according to claim 8, wherein the support plate member is ring-shaped with an outer diameter substantially the same as an outer diameter of the outer periphery section of the yoke and an inner edge disposed outside of the core in a radial direction of the support plate member.

10. The wire dot printer head according to claim 1, further comprising an armature spacer provided between the armature and the support plate member.

11. The wire dot printer head according to claim 10, wherein the armature spacer includes guide members that form a side magnetic path with respect to the armature.

12. A wire dot printer comprising:

(i) a wire dot printer head comprising:

a printing wire;

a core to which a coil is wound and which has a pole face;

a yoke which supports the core, the core being formed integrally with the yoke;

an armature which holds the printing wire, and which has an attracted face that is attracted by the core to contact the pole face and a pivot shaft serving as a center of pivoting of the armature; and a support plate member that abuts the pivot shaft, and which is positioned between the yoke and the pivot shaft to prevent contact between the yoke and the pivot shaft;

wherein an attracting direction of attraction force acted on the attracted face by the core and a moving direction in which the attracted face moves due to the attraction force are substantially equal to each other; and wherein a surface of the support plate member is hardened by a hardening process, and the support plate member has a thickness such that a magnetic path between the core and the armature is formed with a shortest distance;

(ii) a platen opposite to the wire dot printer head;

(iii) a carriage that holds the wire dot printer head and reciprocates along the platen;

(iv) a printing medium transporting section that transports a printing medium between the wire dot printer head and the platen; and (v) a unit that drive-controls the wire dot printer head, the carriage and the printing medium transporting section to thereby effect printing based upon printing data.

13. The wire dot printer according to claim 12, wherein a virtual circle is defined such that a center of the pivot shaft is a center of the circle and a shortest distance from the center of the pivot shaft to a center of the attracted face is a radius of the circle, and an angle θ is defined as an angle between a tangential direction, which is tangential to the virtual circle at an intersection of the virtual circle with the attracted face, and the attracting direction of the attraction force, and wherein the attracted face and the pivot shaft are positioned so as to establish a relationship of $\theta \approx 0$.

14. The wire dot printer according to claim 12 or 13, wherein the attracted face and the pivot shaft are positioned on substantially a same plane.

15. The wire dot printer according to claim 12, wherein the yoke includes an outer periphery section having a plurality of recesses.

16. The wire dot printer according to claim 15, wherein the armature includes an arc-shaped portion that slidably fits into one of the plurality of recesses.

17. The wire dot printer according to claim 16, wherein said one of the plurality of recesses includes an inner peripheral face having a concave shape with a curvature radius approximately equal to a curvature radius of an outer peripheral face of the arc-shaped portion of the armature.

18. The wire dot printer according to claim 16, wherein the support plate member has grooves aligned with the recesses of the yoke to permit access to the recesses of the yoke by the arc-shaped portion of the armature.

19. The wire dot printer according to claim 15, wherein the support plate member is substantially flat.

20. The wire dot printer according to claim 19, wherein the support plate member is ring-shaped with an outer diameter substantially the same as an outer diameter of the outer periphery section of the yoke and an inner edge disposed outside of the core in a radial direction of the support plate member.

21. The wire dot printer according to claim 12, further comprising an armature spacer provided between the armature and the support plate member.

22. The wire dot printer according to claim 21, wherein the armature spacer includes guide members that form a side magnetic path with respect to the armature.

23. A wire dot printer head, comprising:

a printing wire;

a core to which a coil is wound and which has a pole face;

a yoke which supports the core, the core being formed integrally with the yoke;

an armature which holds the printing wire, and which has an attracted face to contact the pole face and a pivot shaft serving as a center of pivoting of the armature; and a support plate member that abuts the pivot shaft, and which is positioned between the yoke and the pivot shaft to prevent contact between the yoke and the pivot shaft;

wherein a height of the pole face of the core and a center of rotation of the pivot shaft supported by the support plate member are substantially equal; and wherein a surface of the support plate member is hardened by a hardening process, and the support plate member has a thickness such that a magnetic path between the core and the armature is formed with a shortest distance.

24. A wire dot printer head, comprising:

a printing wire;

a core to which a coil is wound and which has a pole face;

a yoke which supports the core, the core being formed integrally with the yoke;

an armature which holds the printing wire, and which has an attracted face that is attracted by the core to contact the pole face and a pivot shaft serving as a center of pivoting of the armature; and a support plate member that abuts the pivot shaft, and which is positioned between the yoke and the pivot shaft to prevent contact between the yoke and the pivot shaft;

wherein an attraction force acted on the attracted face by the core and a component of the attraction force in a rotating direction of the armature are substantially equal to each other; and wherein a surface of the support plate member is hardened by a hardening process, and the support plate member has a thickness such that a magnetic path between the core and the armature is formed with a shortest distance.

25. A wire dot printer head, comprising:

a printing wire;

a core to which a coil is wound and which has a pole face;

a yoke which supports the core, the core being formed integrally with the yoke;

an armature which holds the printing wire, and which has an attracted face to contact the pole face and a pivot shaft serving as a center of pivoting of the armature; and a flat ring-shaped support plate member that abuts the pivot shaft, and which is positioned between the yoke and the pivot shaft to prevent contact between the yoke and the pivot shaft;

wherein the support plate member has an outer edge and an inner edge, and the inner edge is disposed outside of the core in a radial direction of the support plate member; and wherein a surface of the support plate member is hardened by a hardening process, and the support plate member has a thickness such that a magnetic path between the core and the armature is formed with a shortest distance.

26. A wire dot printer head, comprising:

a printing wire;

a core to which a coil is wound and which has a pole face;

a yoke which supports the core, the core being formed integrally with the yoke;

an armature which holds the printing wire, and which has a pivot center and an attracted face to contact the pole face;

an armature spacer which is positioned between the core and the armature, and which includes an outer-periphery ring-shaped member with openings, the armature extending through one of the openings; and a support plate member which abuts a portion of the armature, and which is positioned between the yoke and the armature spacer to prevent contact between the yoke and said portion of the armature;

wherein a height of the pole face of the core and a center of rotation of the pivot center of the armature are substantially equal; and wherein a surface of the support plate member is hardened by a hardening process, and the support plate member has a thickness such that a magnetic path between the core and the armature is formed with a shortest distance.

27. A wire dot printer, comprising:

the wire dot printer head according to claim 26;

a platen opposite to the wire dot printer head;

a carriage that holds the wire dot printer head and reciprocates along the platen;

a printing medium transporting section that transports a printing medium between the wire dot printer head and the platen; and a unit that drive-controls the wire dot printer head, the carriage and the printing medium transporting section to thereby effect printing based upon printing data.

28. A wire dot printer head, comprising:

a printing wire;

a core to which a coil is wound and which has a pole face;

a yoke which supports the core, the core being formed integrally with the yoke;

an armature which holds the printing wire, and which has a pivot center and an attracted face that is attracted by the core to contact the pole face;

an armature spacer which is positioned between the core and the armature, and which includes an outer-periphery ring-shaped member with openings, the armature extending through one of the openings; and a support plate member which abuts a portion of the armature, and which is positioned between the yoke and the armature spacer to prevent contact between the yoke and said portion of the armature;

wherein an attraction force acted on the attracted face by the core and a component of the attraction force in a rotating direction of the armature are substantially equal to each other; and wherein a surface of the support plate member is hardened by a hardening process, and the support plate member has a thickness such that a magnetic path between the core and the armature is formed with a shortest distance.

29. A wire dot printer, comprising:

the wire dot printer head according to claim 28;

a platen opposite to the wire dot printer head;

a carriage that holds the wire dot printer head and reciprocates along the platen;

a printing medium transporting section that transports a printing medium between the wire dot printer head and the platen; and a unit that drive-controls the wire dot printer head, the carriage and the printing medium transporting section to thereby effect printing based upon printing data.

30. A wire dot printer head, comprising:

a printing wire;

a core to which a coil is wound and which has a pole face;

a yoke which supports the core, the core being formed integrally with the yoke;

an armature which holds the printing wire, and which has a pivot center and an attracted face to contact the pole face;

an armature spacer which is positioned between the core and the armature, and which includes an outer-periphery ring-shaped member with openings, the armature extending through one of the openings; and a substantially flat, ring-shaped support plate member which abuts a portion of the armature, and which is positioned between the yoke and the armature spacer to prevent contact between the yoke and said portion of the armature;

wherein the support plate member has a radial width approximately equal to a radial width of the outer-periphery ring-shaped member; and wherein a surface of the support plate member is hardened by a hardening process, and the support plate member has a thickness such that a magnetic path between the core and the armature is formed with a shortest distance.

31. A wire dot printer, comprising:

the wire dot printer head according to claim 30;

a platen opposite to the wire dot printer head;

a carriage that holds the wire dot printer head and reciprocates along the platen;

a printing medium transporting section that transports a printing medium between the wire dot printer head and the platen; and a unit that drive-controls the wire dot printer head, the carriage and the printing medium transporting section to thereby effect printing based upon printing data.

32. A wire dot printer head, comprising:

a printing wire;

a core to which a coil is wound and which has a pole face;

a yoke which supports the core, the core being formed integrally with the yoke;

an armature which holds the printing wire, and which has a pivot center and an attracted face to contact the pole face; and a support plate member which abuts a portion of the armature, and which is positioned between the yoke and said portion of the armature to prevent contact between the yoke and said portion of the armature;

wherein the support plate member comprises a substantially flat, ring-shaped member having an outer edge and an inner edge, and the inner edge is disposed outside of the core in a radial direction of the support plate member; and wherein a surface of the support plate member is hardened by a hardening process, and the support plate member has a thickness such that a magnetic path between the core and the armature is formed with a shortest distance.

33. A wire dot printer, comprising:

the wire dot printer head according to claim 32;

a platen opposite to the wire dot printer head;

a carriage that holds the wire dot printer head and reciprocates along the platen;

a printing medium transporting section that transports a printing medium between the wire dot printer head and the platen; and a unit that drive-controls the wire dot printer head, the carriage and the printing medium transporting section to thereby effect printing based upon printing data.

* * * * *